US011353291B2

(12) United States Patent
Lander et al.

(10) Patent No.: US 11,353,291 B2
(45) Date of Patent: Jun. 7, 2022

(54) BULLET-RESISTANT WEARABLE ARTICLE

(71) Applicant: Innotech International LLC, Wilmington, DE (US)

(72) Inventors: Victor Lander, Short Hills, NJ (US); Jacob Gitman, Bay Harbor Island, FL (US)

(73) Assignee: INNOTECH INTERNATIONAL, LLC, Wilmington, DE (US)

( * ) Notice: Subject to any disclaimer, the term of this patent is extended or adjusted under 35 U.S.C. 154(b) by 82 days.

(21) Appl. No.: 16/681,460

(22) Filed: Nov. 12, 2019

(65) Prior Publication Data

US 2021/0140744 A1 May 13, 2021

(51) Int. Cl.
*F41H 1/02* (2006.01)
*A45F 4/02* (2006.01)
(Continued)

(52) U.S. Cl.
CPC ..... *F41H 1/02* (2013.01); *A41D 31/24* (2019.02); *A45F 3/04* (2013.01); *A45F 4/02* (2013.01)

(58) Field of Classification Search
CPC ..... A45F 2004/023; A45F 4/02; A45F 3/06; F41H 1/02; F41H 5/08
(Continued)

(56) References Cited

U.S. PATENT DOCUMENTS 3,963,199 A * 6/1976 Pravaz ..... B64D 17/46 244/148
5,873,506 A * 2/1999 Golling ..... A45F 3/02 224/153
(Continued)

FOREIGN PATENT DOCUMENTS

CN 105686313 A * 6/2016
CN 206182618 U * 5/2017

OTHER PUBLICATIONS

English Translation of CN105686313 provided by ESPACENET.*

*Primary Examiner* — Scott T McNurlen
(74) *Attorney, Agent, or Firm* — Henry M. Feiereisen LLC

(57) ABSTRACT

A bullet-resistant user's wearable article convertible from a bullet-resistant backpack configuration and a bullet-resistant vest configuration and vice versa has two parts each provided with a bullet-proof shield and moveable relative to one another between a first position in which they are located at one side of a user's torso and assume the bullet-resistant backpack configuration and a second position which is assumed when one of them is turned around a user's torso and they become located at two opposite sides of the user's torso to assume the bullet-resistant vest configuration, a first connection releasably connecting the two parts with one another in the first position in which they are located at one side of the user's torso, a second connection located at one side of each of the Iwo parts for non-releasably connecting them with one another in the first position in which the parts are located at one side of the user's torso and in the second position in which the parts are located at opposite sides of the user's torso, and a third connection located at another opposite side of each of the two parts and releasably connecting the opposite sides of the two parts with one another in the second position in which the parts are located at the opposite sides of the user's torso.

3 Claims, 5 Drawing Sheets

(51) Int. Cl.
*A45F 3/04* (2006.01)
*A41D 31/24* (2019.01)

(58) Field of Classification Search
USPC ..... 224/575, 581, 604, 623–624, 631, 224/646–647, 195, 197, 634, 907
See application file for complete search history.

(56) References Cited

U.S. PATENT DOCUMENTS

| | | | | |
|---|---|---|---|---|
| 9,820,558 | B1 * | 11/2017 | De Geus | A45F 3/06 |
| 2002/0113103 | A1 * | 8/2002 | O' Hare | A45F 3/08 224/155 |
| 2011/0240692 | A1 * | 10/2011 | Park | A45C 5/02 224/155 |
| 2018/0317635 | A1 * | 11/2018 | Quon-Chow | A45F 4/02 |

* cited by examiner

BULLET-RESISTANT WEARABLE ARTICLE

BACKGROUND OF THE INVENTION

The present invention relates to bullet-resistant wearable articles, and in particular to such bullet-resistant wearable article which are convertible to form a bullet-proof backpack or a bullet-proof vest.

Bullet-resistant user's wearable articles of this type are generally known in the art. Some of such articles are disclosed for example in US Patent. Publication No. 2018/0317635 and U.S. Pat. No. 10,306,971. The bullet resistant user's wearable articles disclosed in these references include parts which are connected with one another so that in order to covert the article from a position in which both parts are located at one side of a user's torso to a position in which these parts are located at opposite sides of the user's torso, it is necessary to separate the parts and then to put it over the user's head. This is however very inconvenient in alarm situations and can be even not possible, especially for children.

SUMMARY OF THE INVENTION

Accordingly, it is an object of the present invention to provide a bullet-resistant user's wearable article which avoids the above-mentioned disadvantages of the known bullet-resistant user's wearable articles.

In keeping with these objects and with others which will become apparent hereinafter, one feature of the present invention resides, briefly stated hi a bullet-resistant user's wearable article which is convertible from a bullet-resistant backpack configuration and a bullet-resistant vest configuration and vice versa and comprises two parts each provided with a bullet-proof shield and moveable relative to one another between a first position in which the two parts are located at one side of a user's torso and assume the bullet-resistant backpack configuration and a second position which is assumed when one of the two parts is turned around the user's torso and the two parts become located at two opposite sides of the user's body to assume the bullet-resistant vest configuration, first connecting means releasably connecting the two parts with one another in the first position in which the parts are located at one side of the user's torso, second connecting means located at one side of each of the two parts for non-releasably connecting the two parts with one another in the first position in which the parts are located at one side of the user's torso and in the second position in which the parts are located at opposite sides of the user's torso, and third connecting means located at another opposite side of each of the two parts and releasably connecting the opposite sides of the two parts with one another in the second position in which the parts are located at the opposite sides of the user's torso.

As a result, in the first position the first connecting means keep the parts connected with one another in the backpack configuration by the first connecting means, then the first connecting means can be released and one of the parts can be turned around a use's torso so that the parts become located at opposite side of the users torso and assume the vest configuration in the second position, and then the third connecting means connect the parts with each other in the vest configuration in the second position, while the second connecting means keep the parts connected with each both in the backpack configuration in the first position and in the vest configuration in the second position.

A further feature of the present invention resides in that the first connecting means for releasably connecting the parts with one another in the first position is formed as means selected from the group consisting of a zipper, a plurality of buttons, a magnet, and a hook and loop fastener.

A further feature of the present invention resides in that the second connecting means for non-releasably connecting the two parts with one another in the first position and in the second position is formed as a stretchable elastic element.

A further feature of the present invention resides in that the stretchable elastic element of the second connecting means has two opposite end portions that are connected with inner surfaces of the first part and the second part.

A further feature of the present invention resides in that the third connecting means for releasably connecting the two parts in the second position with one another includes a first element fixedly connected to an inner surface of one the first and second parts and a second element fixedly connected to an inner surface of another one of the two parts and also releasably connectable with said first element.

A further feature of the present invention resides in that said third connecting means also include a ring, connected to said second element and also accessible to a user from outside of the parts and pullable by a user so as to disconnect said second element from said first element.

A further feature of the present invention resides in that said first and second elements are formed as a hook element and a loop element.

The novel features of the present invention for which a Letters Patent is requested are specified in particular in the appended claims.

The invention itself however both as to its construction and a manner of operation will be best understood from the following description of preferred embodiments, which is accompanied by the following drawings.

DESCRIPTION OF THE PREFERRED EMBODIMENTS

Figure 3:
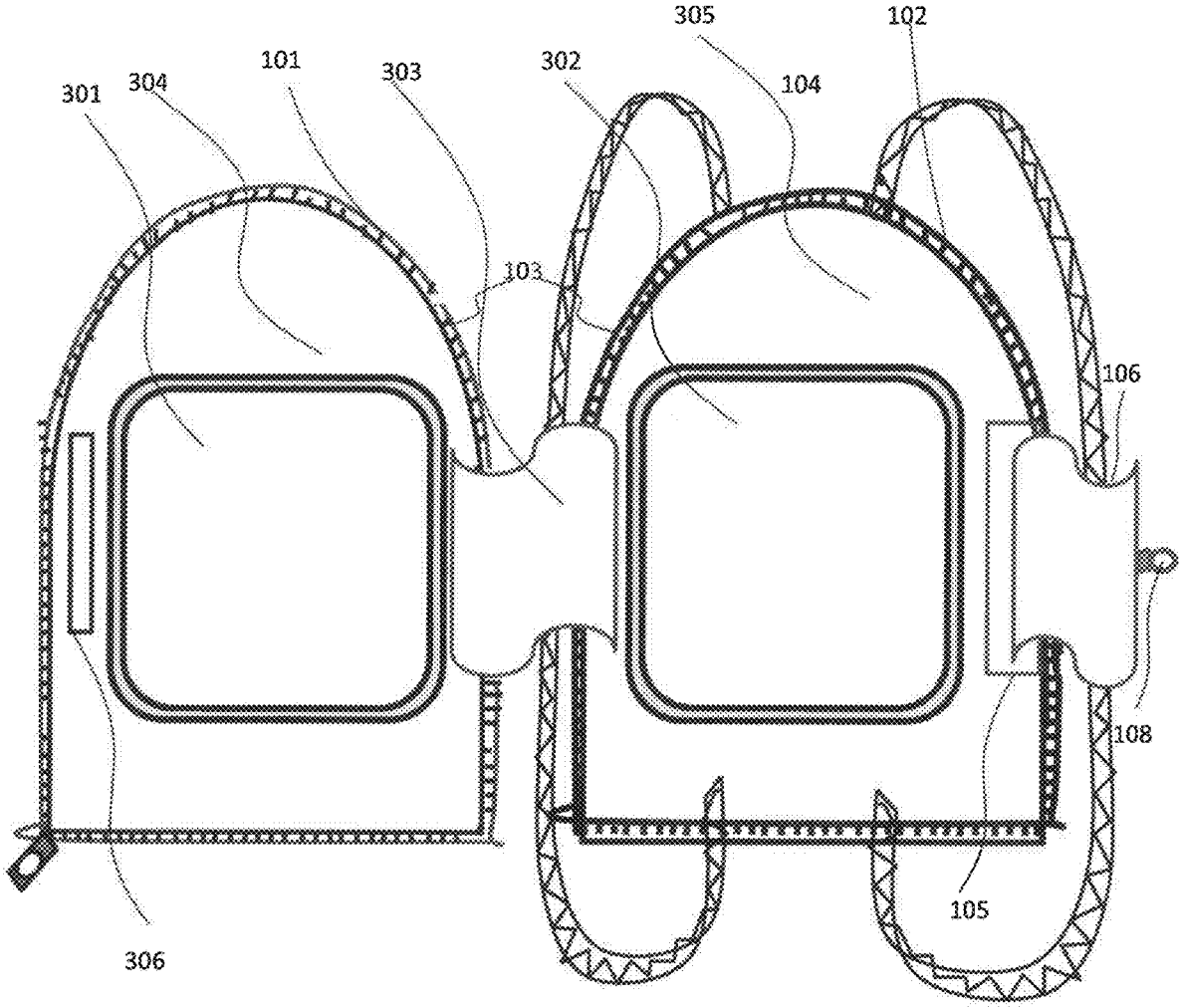
FIG. 3 of the drawings in a view showing the bullet-resistant user's wearable article which has the two parts each provided with a bullet-proof shield and arranged in an intermediate open position in which inner elements of the two parts illustrated in detail.

A bullet-resistant user's wearable article according to the present invention is identified as a whole with reference numeral 100. It has two parts 101 and 102 provided with bullet-proof shields 301 and 302 correspondingly, Each of the bullet-proof shields is made of a bullet-resistant armor material, a bullet-resistant material, and the like. As can be seen for example in FIGS. 3 and 4 the bullet-proof shield 301 can be accommodated in a pocket 401 on an inner surface 304 of the part 101, while the bullet-proof shield 302 can be accommodated in a pocket 402 on an inner surface 305 of the part 102.

The bullet-resistant armor material or the bullet-resistant material of bullet-proof shields 301 and 302 can be for example composed of Kevlar™, metal, ceramics, polyethylene, laminated fibers, multi-layered woven material, or another corresponding material, as well any combinations of the above-specified materials, which provide resisting ballistic projectiles, shrapnel, etc, preventing penetration of any damaging assault element into the interior of the user's wearable article according to the present invention.

Figure 1:
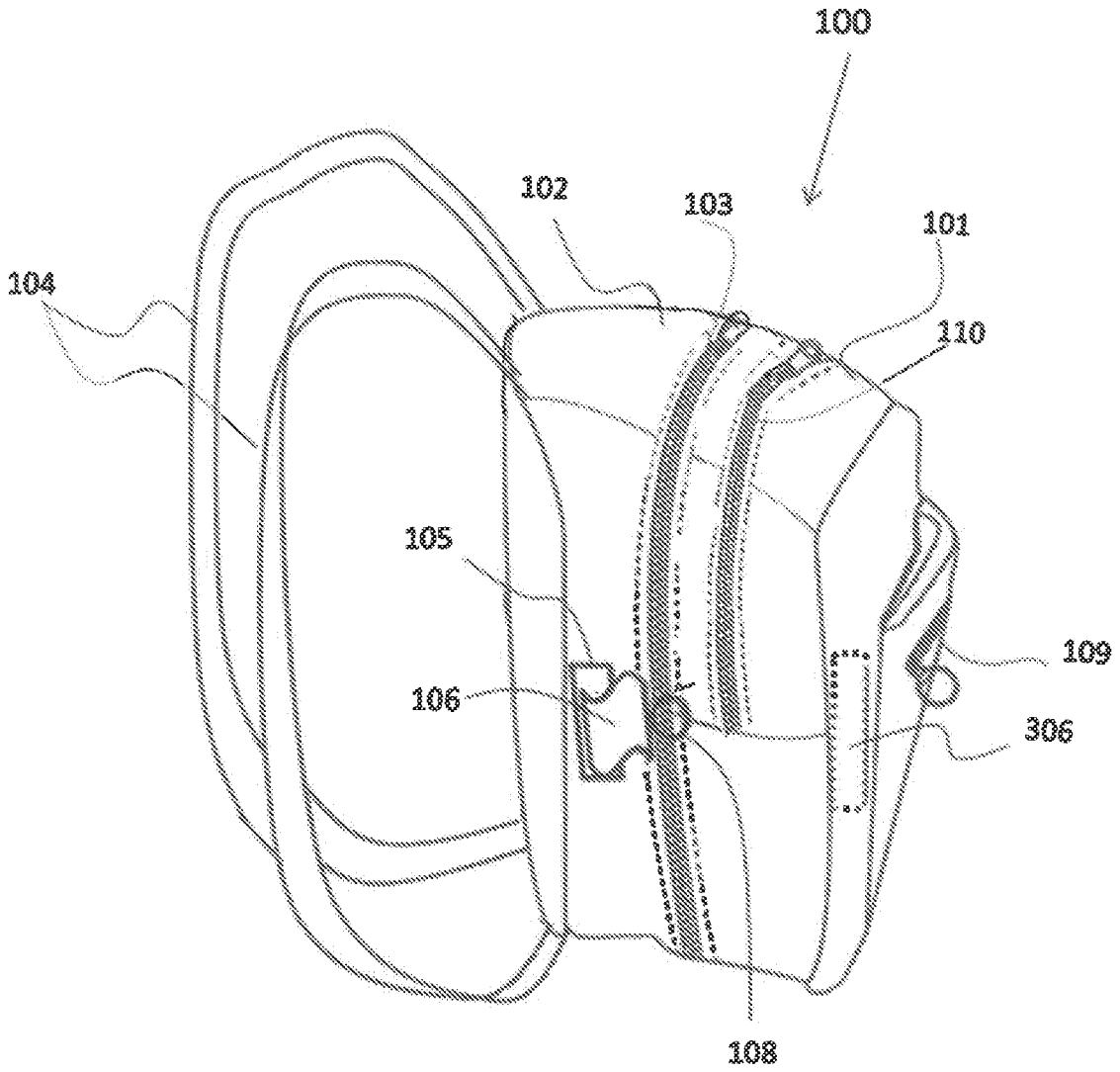
FIG. 1 of the drawings in a view showing one side of a bullet-resistant users wearable article which has two parts each provided with a bullet-proof shield and arranged in a first position in which the two parts are located at one side of a user's torso and form a bullet-proof backpack.
Figure 4:
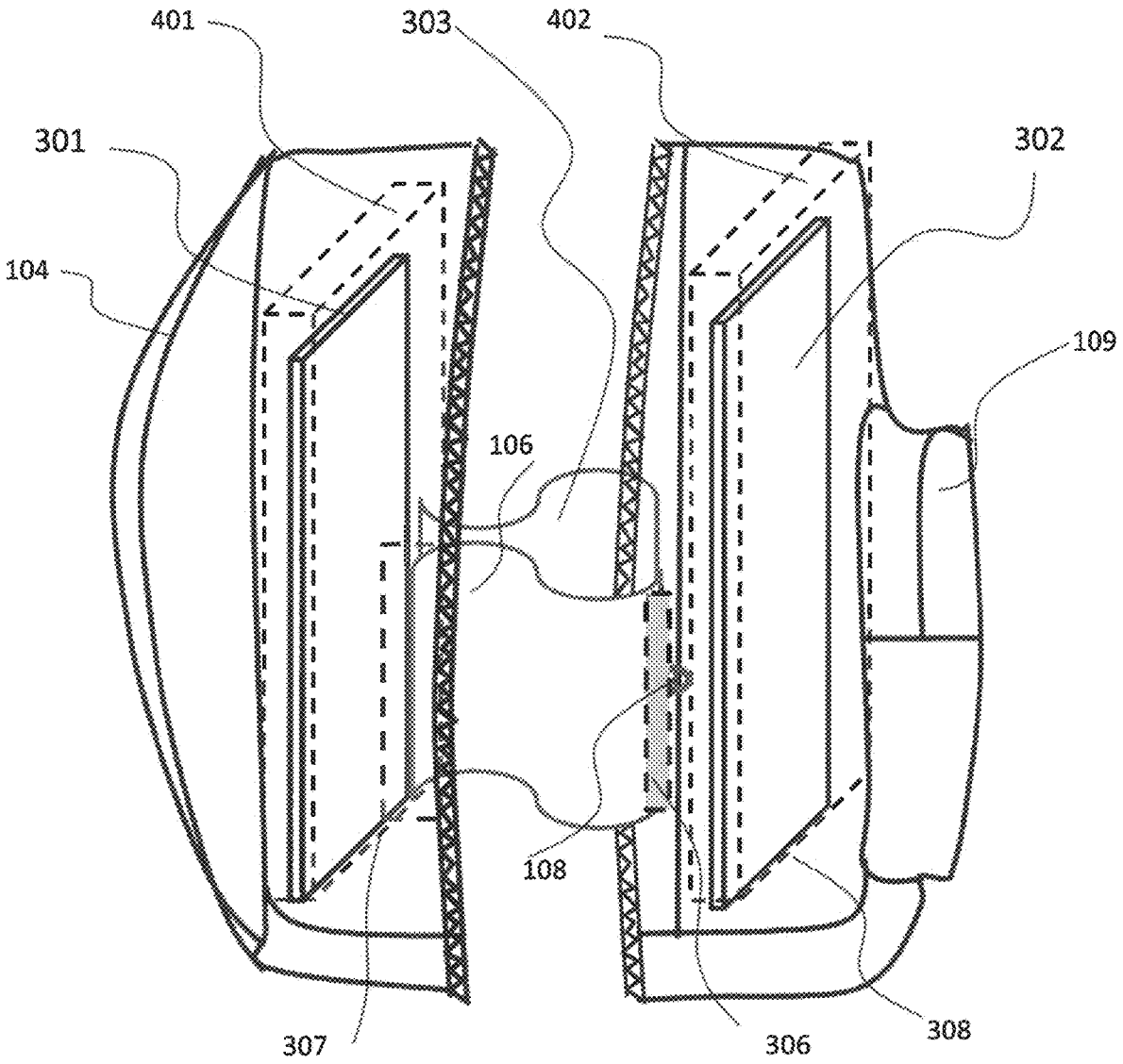
FIG. 4 of the drawings in a perspective view showing the bullet-resistant user's wearable article which has two parts each provided with a bullet-proof shield and arranged in a second position in which the two parts are spaced from each other so as to be located at two opposite sides of a user's torso and form a bullet-proof vest.
Figure 5A:
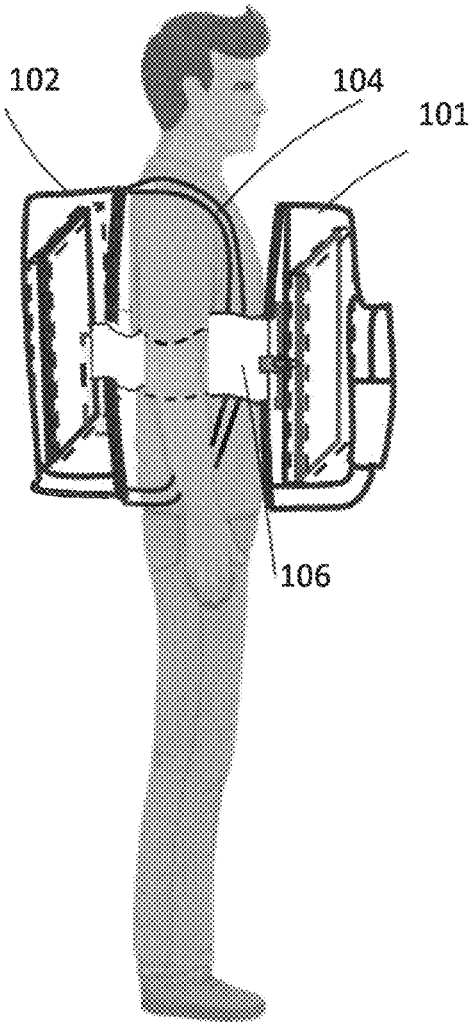
FIGS. 5*a* and 5*b* are views showing from both sides a user who is wearing the bullet-resistant user's wearable article which the two parts arranged in the second position in which the two parts are spaced from each other and located at two opposite sides of a user's torso, thus forming a bullet-proof vest.
Figure 5B:
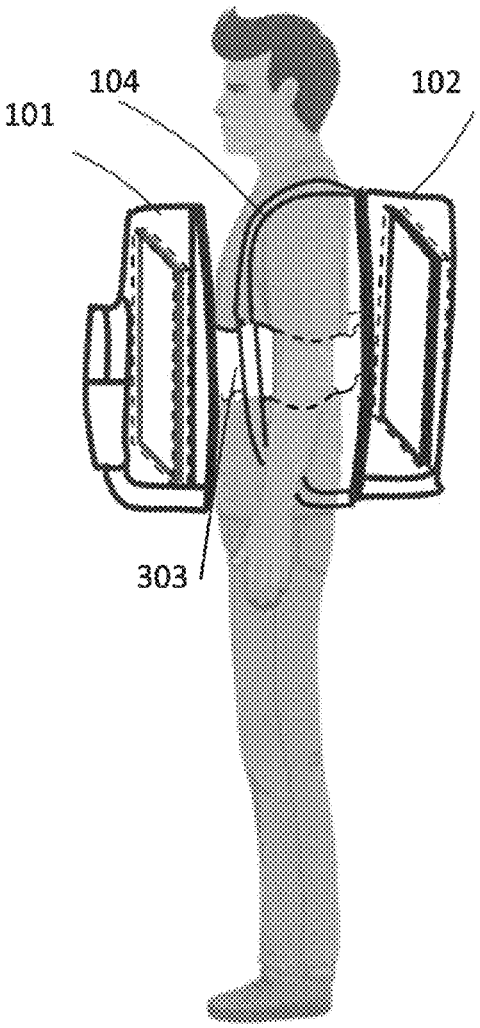

The two parts 101 and 102 of the inventive bullet-resistant user's wearable article are moveable relative to one another between a first position in which these two parts 101 and 102 can be located at one side of a user's torso as shown in FIG. 1 in a backpack configuration, and a second position which is assumed when one of the two parts 101 or 102 is turned around the user's torso and the two parts 101 and 102 become located at two opposite sides of the user's torso as shown in FIGS. 4, 5*a*, 5*b* in a vest configuration.

Connecting means are further provided for connecting the two parts 101 and 102 with one another in a special way according to the present invention.

Figure 2:
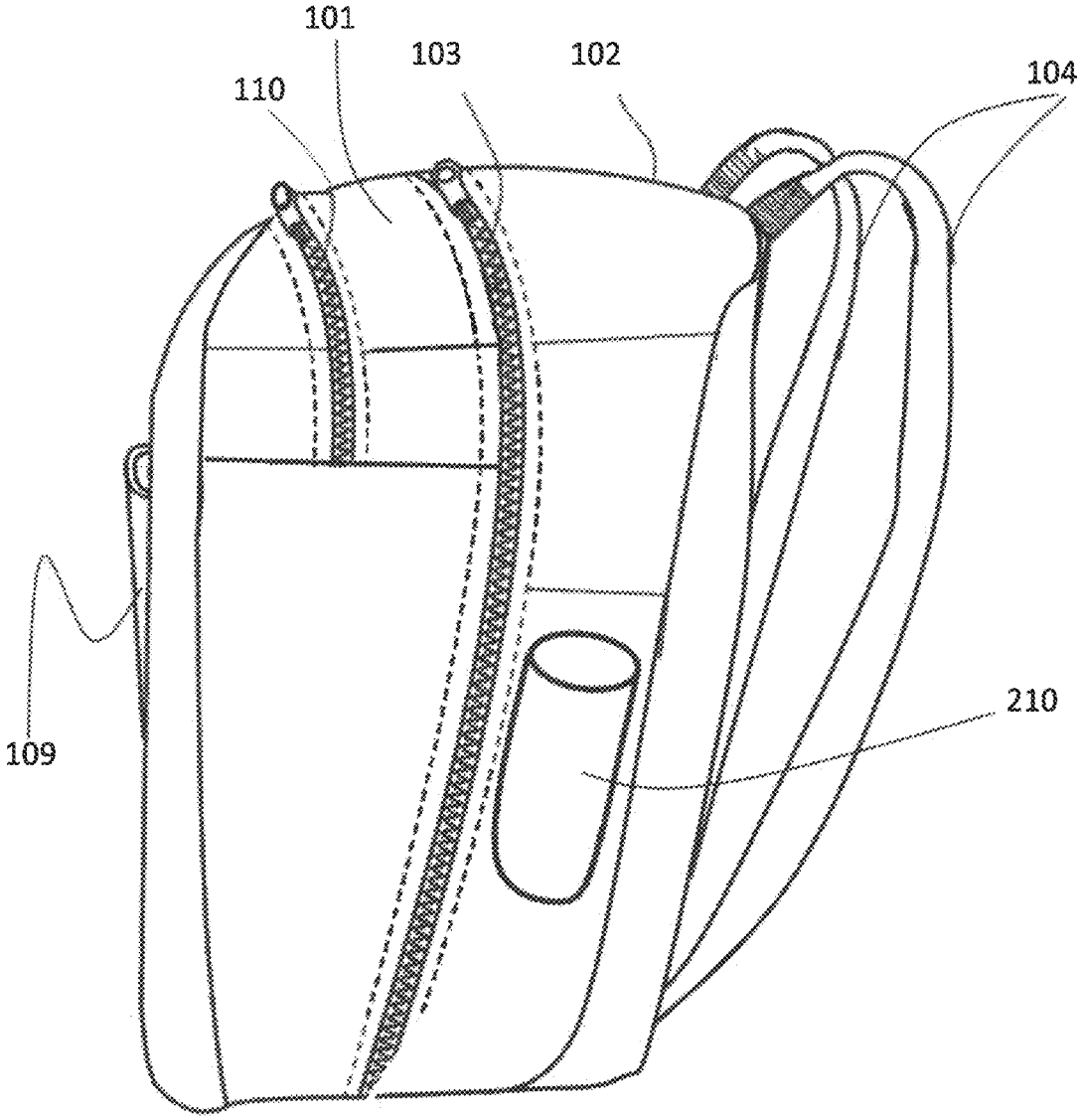
FIG. 2 of the drawings in a view showing another opposite side of the bullet-resistant user's wearable article which has the two parts each provided with the bullet-proof shield and arranged in the first position in which the two parts are located at the one side of the user's torso and form the bullet-proof backpack.

The connecting means of the invention include first connecting means 103 which releasably connect the parts 101 and 102 in the first position in which the article has a backpack configuration shown in FIGS. 1 and 2. The first connecting means can be formed as a fastening mechanism, such a zipper, a plurality of buttons, a magnet, a hook and loop fastener, and the like. When the first connecting means 103 is formed as a zipper, it can be moved by a user in one direction and the parts 101 and 102 are disconnected from one another, and moved by a user in another opposite direction and the parts 101 and 102 become connected with one another again.

The connecting means of the invention further include second connecting means 303 located at one side of each the two parts 101 and 102 and configured for non-releasably connecting the two parts 101 and 102 with one another in the first position shown in FIG. 1 and in the second position shown in FIGS. 4, 5*a*, Sb. The second connecting means 303 can be formed for example as a stretchable elastic strap whose opposite ends can be attached to the inner surface 304 of the part 101 and to the inner surface 305 of the part 102. Whether the parts 101 and 102 are located in the first position at one side of the user's torso as shown in FIG. 1, or the parts 101 and 102 are located in the second position at opposite sides of the user's torso as shown in FIGS. 4, 5*a*, Sb, the second connecting means 303 non-releasably connect the parts 101 and 102 with one another.

The connecting means further include third connecting means of the invention and releasably connect the two parts 101 and 102 with one another in the second position in the backpack configuration shown in FIGS. 4, 5*a*, 5*b*. The third connecting means includes a strap 106 provided with hooks and attached to the inner surface 305 of the part 102 with insertion of its loose end in a pocket 105, and a patch 306 provided with loops and attached to the inner surface 304 of the part 101. In the position shown in FIGS. 4, 5*a*, 5*b* the strap 106 provided with the hooks engages with the loops of the patch 306. A ring 108 is further connected to a free end of the strap 106 and extends outwardly from the parts 101 and 102. It can be pulled by a user to disconnect the strap 106 from the patch 306.

Since the parts 101 and 102 of the bullet-resistant user's wearable article are permanently connected with one another at the one side and releasably connected at the other opposite side, the parts 101 and 102 can be disconnected from the first position of the backpack configuration shown in FIGS. 1, 2 to allow turning of one part of the parts 101 or 102 from the first position around the user's torso and a subsequent connection of the thusly turned one part 101 or 102 with the other part correspondingly 102 or 101 in the second position of the vest configuration. This is very convenient to be implemented in any situation, including in emergency and alarm situations, and can be easily and simply performed by any users, even by children.

The bullet-resistant user's wearable article according to the present invention further has straps 104 enabling a user to carry it on the back or across the shoulders in the backpack configuration. A fastening element 110 which can be formed as a zipper and the like is also provided and it can open the part 101 to access its interior. An element 210 is arranged on a side of the article and used for inserting of additional objects as needed.

The present invention is not limited to the details shown since various modifications and structural changes are possible without departing from the spirit of the invention.

The invention claimed is:

1. A bullet-resistant user's wearable article convertible from a bullet-resistant backpack configuration to a bullet-resistant vest configuration and vice versa, comprising two parts each provided with a bullet-proof shield and moveable relative to one another between a first position in which said two parts are located at a back side of a user's torso of a standing user and assume the bullet-resistant backpack configuration and a second position which is assumed when one of said two parts is turned around a user's torso and said two parts become located at two opposite sides of the users torso protecting substantially front and back sides of the user's torso to assume the bullet-resistant vest configuration;

first connecting means which releasably connect the two parts in the backpack configuration;

second connecting means which non-releasably connect the parts in the backpack configuration and in the vest configuration and consist of a single stretchable elastic strap located at one side of the parts in the vest configuration; and third connecting means which releasably connect the parts in the vest configuration and is located at another opposite side of the parts in the vest configuration, the third connecting means including a strap provided with hooks and attached to an inner surface of one of the parts and also having a loose end insertable in a pocket, and a patch provided with loops and attached to an inner surface of the other of the parts, with the hooks of the strap engaging with the loops of the patch.

2. A bullet-resistant user's wearable article as defined in claim 1, wherein said stretchable elastic strap of the second connecting means has one end connected to an inner surface of one of the parts and another end connected to an inner surface of the other one of the parts.

3. A bullet-resistant user's wearable article as defined in claim 1, wherein said second connecting means and said third connecting means are formed so that the bullet-resistant users wearable article can be converted from the bullet-resistant backpack configuration to the bullet-resistant vest configuration without removing the article from user's shoulders and also can be extended to a thicker body of a user at both sides of the article.

* * * * *